United States Patent [19]

Bassist

[11] 4,096,610

[45] Jun. 27, 1978

[54] METHOD OF KNITTING A VELOUR FABRIC

[76] Inventor: Rudolph G. Bassist, 1003 McGrann Blvd., Lancaster, Pa. 17601

[21] Appl. No.: 853,683

[22] Filed: Nov. 21, 1977

[51] Int. Cl.[2] ..... D02G 1/16

[52] U.S. Cl. ..... 28/159; 66/202

[58] Field of Search ..... 66/202, 194; 28/159, 28/160

[56] References Cited

U.S. PATENT DOCUMENTS

| | | | |
|---|---|---|---|
| 1,980,191 | 11/1934 | Dickie et al. | 28/160 |
| 3,757,541 | 9/1973 | Frohlich | 60/202 |
| 3,848,556 | 11/1974 | Terada et al. | 66/202 |

FOREIGN PATENT DOCUMENTS

| | | | |
|---|---|---|---|
| 50-37789 | 12/1975 | Japan | 60/202 |
| 550,525 | 1/1943 | United Kingdom | 28/159 |

*Primary Examiner*—Ronald Feldbaum
*Attorney, Agent, or Firm*—Alan H. Levine

[57] ABSTRACT

A knitted velour fabric is made by knitting a ground fabric and knitting velour threads on to the ground fabric. Each velour thread is formed as a series of elongated loops knitted into the ground fabric only at their bases. Stitches of soluble yarn are knitted on to the ground fabric to temporarily hold the elongated velour loops against one face of the ground fabric. Thereafter, the fabric is treated with a liquid or vapor to dissolve the soluble yarn and permit the velour loop to project outwardly from the face of the ground fabric.

5 Claims, 4 Drawing Figures

METHOD OF KNITTING A VELOUR FABRIC

This invention relates to knitting, and more particularly to a method of knitting a velour fabric.

Conventionally, velour fabrics have been knit in two ways. According to one method, a double bed knitting machine having two parallel, spaced apart needle bars is used. One of the needle bars carries a series of conventional knitting needles, upon which a ground fabric is knitted, and the other a series of straight pins about which the velour threads knitted into the ground fabric are looped to form the velour loops. Alternatively, both needle bars carry conventional knitting needles and the velour threads extending between the two needle bars are cut to leave a multiplicity of single high pile threads projecting from the ground fabric. The disadvantage of using a double needle bed machine is that it is expensive and does not operate as fast as a single needle bar machine.

The other conventional method involves using a single needle bar knitting machine and overfeeding velour threads to the needle bar so to form enlarged loops. However, a disadvantage of this method is that the velour thread often becomes tangled in the needles and guide bars and breaks.

It is an object of the present invention to overcome these problems by providing a method of knitting a velour fabric on a single needle bar machine and controlling the velour loops so as to positively prevent them from becoming tangled in the needles or guide bars.

It is another object of the invention to knit a velour fabric on a single needle bar machine in such a way that the enlarged velour loops are temporarily secured to a face of the ground fabric during the knitting operation so as to prevent them from accidently becoming tangled in any knitting machine parts, the velour loops being freed after the knitting operation has been completed.

A feature of the invention is the use of a soluble yarn for temporarily securing the velour loops to the ground fabric during knitting, the soluble yarn thereafter being dissolved to free the velour loops.

Additional objects and features of the invention will be apparent from the following description in which reference is made to the accomanying drawings.

Figure 1:
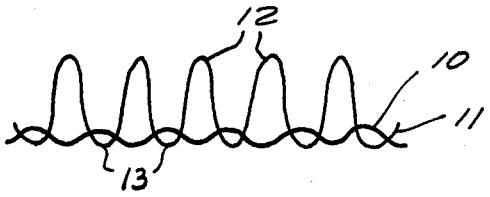
FIG. 1 is a cross-sectional view through a velour fabric.

A velour fabric comprises, as indicated in FIG. 1, a knitted ground fabric 10 carrying velour threads 11, one velour thread being shown in FIG. 1. The velour thread is formed with enlarged loops 12 projecting from a face of ground fabric 10, the bases 13 of the loops being knitted into the ground fabric. FIG. 1 illustrates both a conventional knitted velour fabric and a knitted velour fabric made according to this invention, since the final fabric made according to this invention is indistinguishable from conventional knitted velour fabrics.

Figure 2:
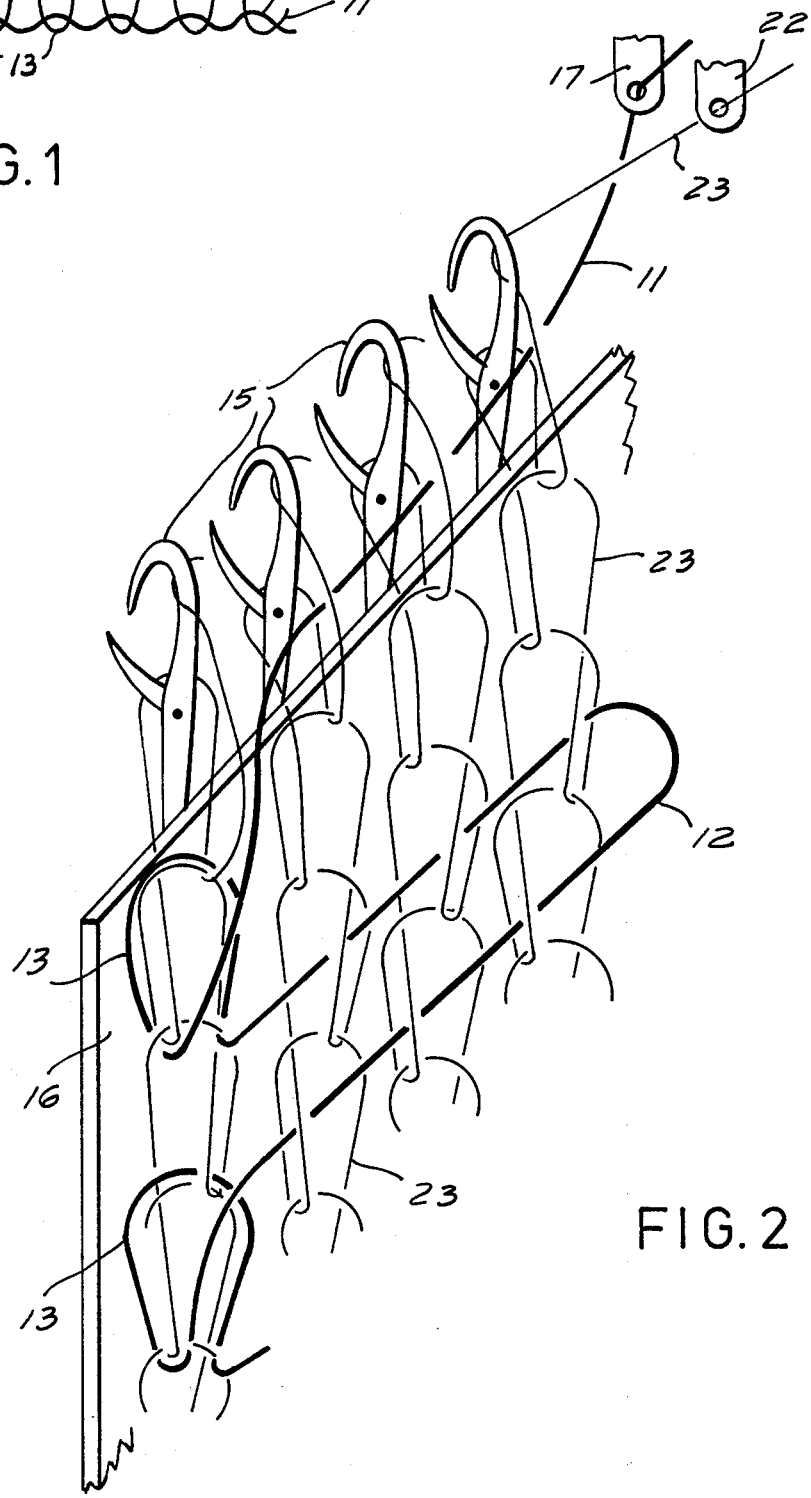
FIG. 2 is a perspective view of a velour fabric being knitted according to the method of the present invention, the ground fabric being omitted for the sake of clarity.
Figure 3:
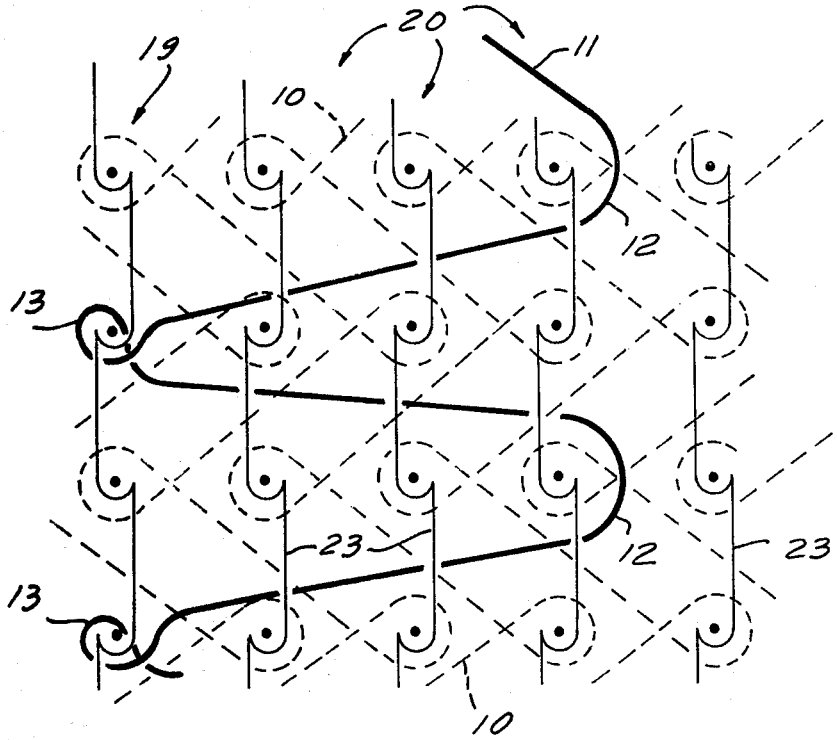
FIG. 3 is a schematic face view of a fabric being knitted according to the method of the present invention.

FIGS. 2 and 3 illustrate the knitting operation according to this invention, the ground fabric 10 not being shown in FIG. 2 for the sake of clarity. In FIG. 3, ground fabric 10 is shown in broken lines. The ground fabric is knitted in a completely conventional way by means of the needles 15 of a single needle bar, which is hidden in FIG. 2 by the usual knock over plate 16, cooperating with a first guide bar (not shown).

By cooperation of needles 15 with a second guide bar carrying thread guides 17 (only one being shown in FIG. 2) velour threads 11 (only one being shown in the drawings) are knitted into ground fabric 10. The particular pattern in which the velour threads are knitted can vary widely. In this example, the thread guides 17 are moved through and around needles 15 to wrap each velour thread 11 around a needle and hence knit what will become the base 13 of a velour stitch or loop into one row of stitches 19 (FIG. 3) of ground fabric 10. The guide bar carrying guides 17 is then moved longitudinally, during the next knitting cycle, to pull each thread 11 across the next three successive rows 20 of ground fabric stitches so as to form an elongated velour loop 12, i.e., a lay-in stitch, when that guide bar is moved longitudinally back to its original position. Although only one velour thread 11 is shown in the drawings, a velour thread may be knitted into each vertical row (as viewed in FIGS. 2–4) of ground stitches, or every other row, or in any pattern desired. The length of each velour loop 12 can also be varied as desired.

By cooperation of needles 15 with a third guide bar carrying thread guides 22 (only one being shown in FIG. 2) soluble yarn 23 is knitted into ground fabric 10 in such a way that yarn 23 attaches velour loops 12 to one face of the ground fabric, i.e., loops 12 are formed between the ground fabric stitches and the stitches formed with yarn 23. As a result, during the knitting operation, elongated loops 12 never have a chance to project outwardly from ground fabric 10 where they may get caught in the knitting needles or thread guides. Yarn 23 may be any type of known water-soluble yarn, such as those made of polyvinyl alcohol or sodium alginate, or a known yarn soluble in steam. The soluble yarn could also be of the known type soluble in dry cleaning fluid.

Figure 4:
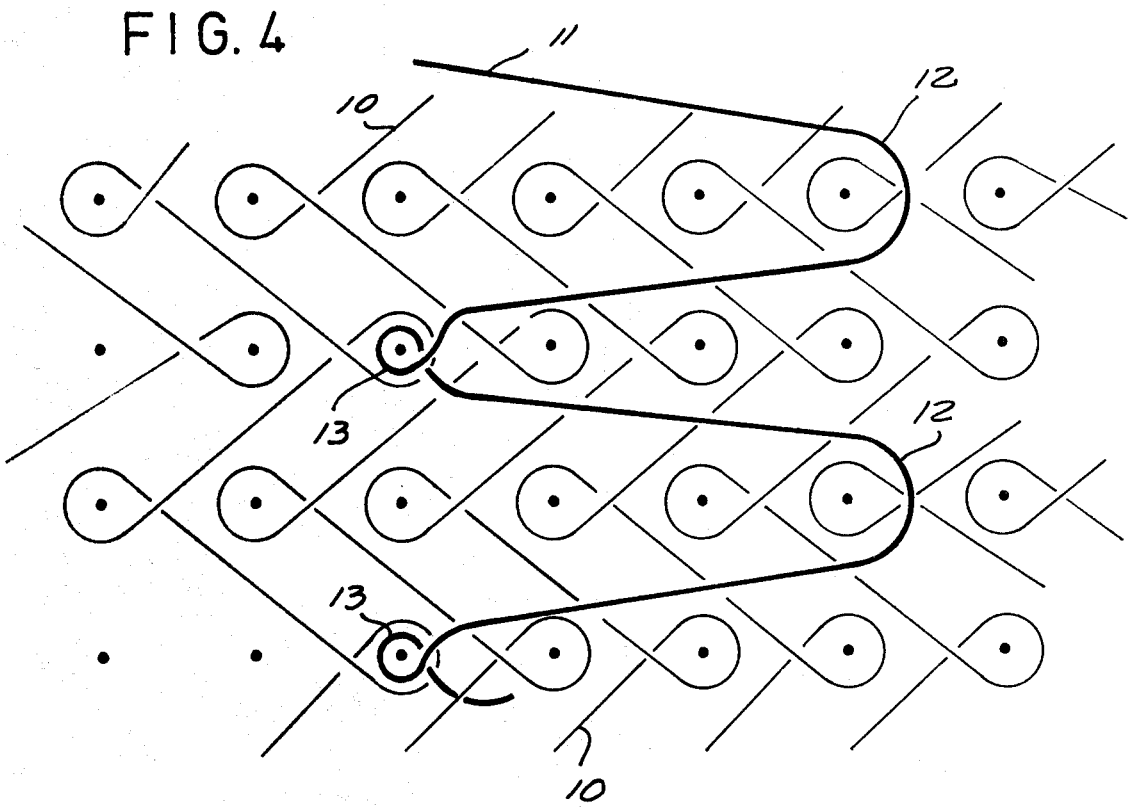
FIG. 4 is a schematic face view of the final velour fabric.

After the knitting operation described above has been completed, the fabric as shown in FIG. 3 is subjected to a treatment which dissolves soluble yarn 23, and leaves the fabric as shown schematically in FIG. 4. This treatment may involve washing in water, in the case of a water-soluble yarn, passing through a steam chamber in the case of steam-soluble yarn, or washing in dry cleaning fluid in the case of yarn soluble in such fluid. Once soluble yarn 23 diappears, velour loops 12 spring away, or can be brushed away, from the face of ground fabric 10 to which they had been attached by yarn 23, so that the fabric appears as illustrated in FIG. 1. The bases 13 of the velour threads remain fixed to the ground fabric.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A method of making a knitted velour fabric, comprising the steps of:

(a) knitting a ground fabric, (b) knitting velour threads on to the ground fabric, each velour thread being formed as a series of elongated loops knitted into the ground fabric only at their bases, (c) knitting stitches of soluble yarn on to the ground fabric to temporarily hold the velour thread loops flat against one face of the ground fabric, and (d) thereafter treating the fabric with a liquid or vapor at a temperature and for a sufficient time to dissolve only the soluble yarn so as to free the velour thread loops to project outwardly from said face of the ground fabric.

2. A method as defined in claim 1 wherein knitting steps (a), (b), and (c) are performed simultaneously.

3. A method as defined in claim 1 wherein each velour thread is knitted into one row of ground fabric stitches, and the velour loops of that thread extend laterally across several successive rows of ground fabric stitches without being knitted into the successive rows of stitches, the soluble yarn stitches temporarily securing the velour loops to at least some of the successive rows of ground fabric stitches.

4. A method as defined in claim 1 wherein the soluble yarn is soluble in water.

5. A method as defined in claim 1 wherein the soluble yarn is soluble in steam.

* * * * *